US006053783A

United States Patent [19]

Brunn

[11] Patent Number: 6,053,783

[45] Date of Patent: Apr. 25, 2000

[54] HUB ASSEMBLY FOR WATER JET PROPULSION UNIT

[75] Inventor: Tommy Brunn, Österbybruk, Sweden

[73] Assignee: MJP Marine Jet Power AB, Osterbybruk, Sweden

[21] Appl. No.: 09/101,535

[22] PCT Filed: Jan. 15, 1997

[86] PCT No.: PCT/SE97/00048

§ 371 Date: Jul. 13, 1998

§ 102(e) Date: Jul. 13, 1998

[87] PCT Pub. No.: WO97/26183

PCT Pub. Date: Jul. 24, 1997

[30] Foreign Application Priority Data

Jan. 16, 1996 [SE] Sweden ..... 9600157

[51] Int. Cl.[7] ..... B63H 20/32; B63H 23/34

[52] U.S. Cl. ..... 440/78; 440/83

[58] Field of Search ..... 440/78, 79, 38, 440/83, 40, 41, 42, 43; 415/112; 416/43, 44, 46

[56] References Cited

U.S. PATENT DOCUMENTS

| | | | |
|---|---|---|---|
| 4,948,384 | 8/1990 | Bland et al. | 440/78 |
| 4,986,775 | 1/1991 | Wantz | 440/83 |
| 5,045,002 | 9/1991 | Torneman et al. . | |
| 5,094,639 | 3/1992 | Onoue | 440/78 |
| 5,554,003 | 9/1996 | Hall | 416/140 |
| 5,827,042 | 10/1998 | Ramsay | 415/112 |

*Primary Examiner*—S. Joseph Morano
*Assistant Examiner*—Patrick Craig Muldoon
*Attorney, Agent, or Firm*—Young & Thompson

[57] ABSTRACT

Hub assembly for the journalling of an impeller (4) or drive shaft end (3) in the pump housing (2) of a water jet propulsion unit for propulsion of a vessel. The hub assembly forms a separate, integrated assembly (6) which as a single unit can be assembled and dismounted from the stem without requiring the pump housing, impeller or drive shaft to be removed from the vessel. The hub assembly is joined together by means of a tightening nut (15), screwed onto a sleeve (9), with an inwardly positioned bearing plate (16) axially holding the sleeve in a bearing housing (8) while concurrently clamping the bearings (10, 11) between said bearing plate and a radially extended flange (17), arranged in the front end of the sleeve, so that the bearing housing, the bearings and the sleeve form a separate, integrated unit.

4 Claims, 1 Drawing Sheet

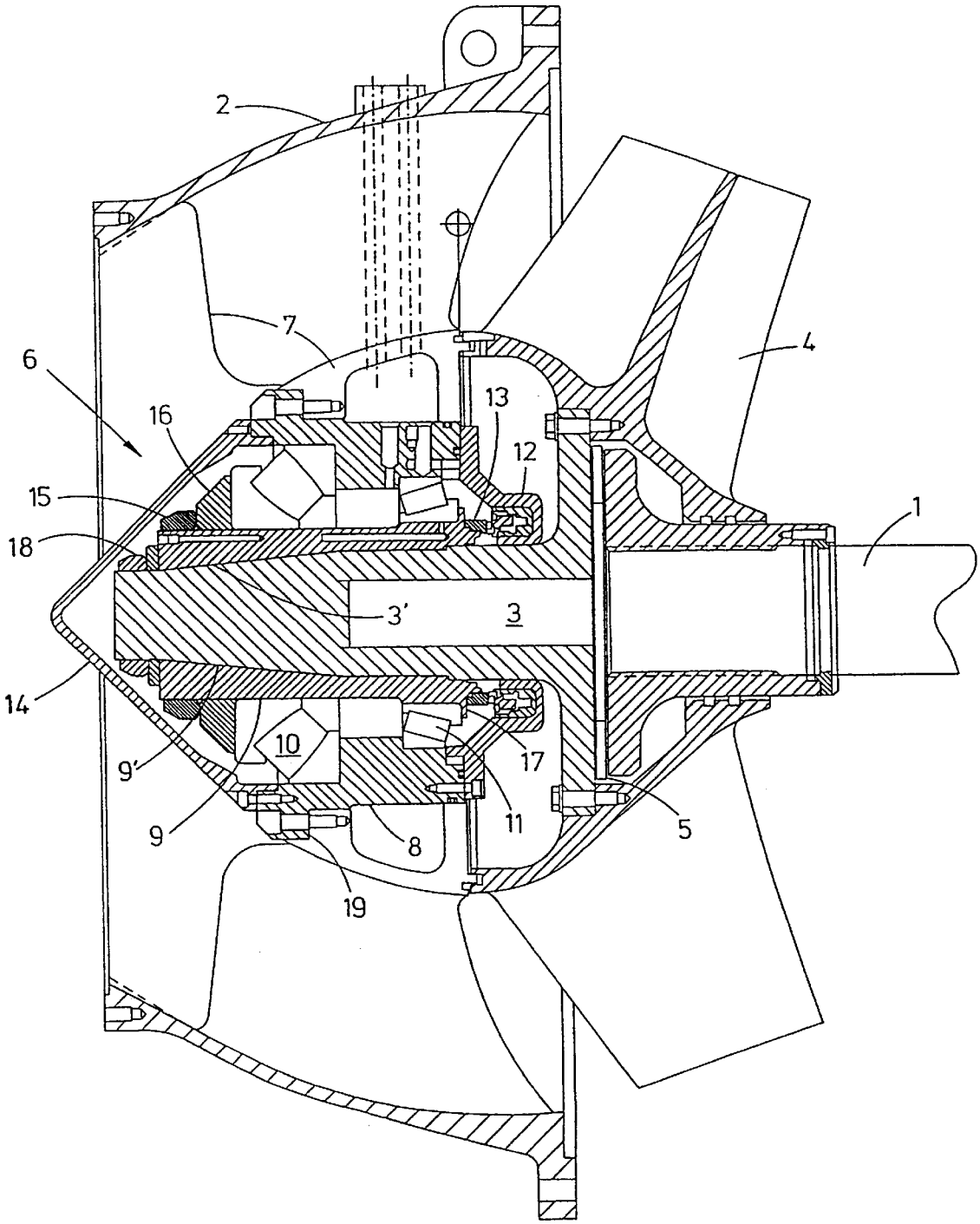
2
7
6
16
15
18
14
9'
9
19
8
10
11
17
13
12
3'
3
4
1
5

HUB ASSEMBLY FOR WATER JET PROPULSION UNIT

TECHNICAL FIELD

The present invention relates to a hub assembly for journalling of the impeller in a pump housing of a water jet propulsion unit adapted for the propulsion of vessels, and is more specifically aimed at providing a hub assembly designed to allow for simplified assembly and dismounting upon replacement or maintenance work.

BACKGROUND ART

A water jet propulsion unit of the type herein referred to comprises a pump wheel or impeller, mounted on a drive shaft which is inserted through the inlet port. The drive shaft end or the impeller is journalled in the pump housing by means of plain bearings or roller bearings and preferably, as in the disclosed embodiment, by an assembly of roller bearings in cooperation.

The hub assembly of the invention is not limited to the use in water jet propulsion units of a specific kind, but may as well be utilized with units that include a flexible, though torsionally stiff connection between drive shaft and impeller as in units with splined couplings or fixed connections between drive shaft and impeller.

For water jet propulsion units of larger commercial ferries and other vessels, swiftness and simplicity of maintenance is an essential economical factor. Current, known designs do not permit dismounting of bearings or replacement of sealings unless the pump is first dismantled from the transom stern. This procedure is both time consuming and complicated since the weight of the propulsion unit increases substantially with increased size and power.

DISCLOSURE OF THE INVENTION

Enabling the simple replacement of a hub assembly or a sealing without the need for dismounting neither the pump nor the pump impeller would substantially simplify the maintenance work at quay. The hub assembly of the invention also permits maintenance of bearings and sealings without the need for lifting or docking the vessel, provided that the vessel can be trimmed at the stem to raise the assembly above the water surface. If water-lubricated plain bearings are utilized in the hub assembly, the replacement could also be made by divers below water surface.

Hence, the purpose of the invention is to provide a hub assembly designed to journal an impeller or a drive shaft end in a water jet propulsion unit that permits simplified assembly and dismounting during maintenance, thereby avoiding the previously described problems.

This purpose is met with a hub assembly according to the enclosed patent claims wherein the specific characteristics of the invention are included.

BRIEF DESCRIPTION OF THE DRAWINGS

The invention is described in more detail below with reference made to the attached drawing which shows, in a longitudinal cross sectional view, the hub assembly mounted in the pump housing of a water jet propulsion unit.

MODE FOR CARRYING OUT THE INVENTION

In the drawing is shown details of a water jet propulsion unit wherein the reference numeral 1 indicates a drive shaft journalled for rotation in a pump housing 2. In the disclosed embodiment, the drive shaft end comprises a shaft spindle 3 having a flange, an impeller 4 being bolted to the flange of the shaft spindle. The shaft spindle is rotationally fixed to the extended end of the drive shaft by means of a coupling 5. The drive shaft end or the shaft spindle 3 is journalled in a hub assembly according to the invention generally indicated with reference numeral 6, the hub assembly 6 being non-rotationally mounted in the pump housing stator 7.

It should be noted that the expression "shaft spindle" in the present disclosure also shall be understood to be equivalent with the drive shaft end, as the invention is not restricted to the illustrated embodiment but is also applicable in such water jet propulsion units that lack the shown connection between the drive shaft and a shaft spindle, non-rotationally attached to the drive shaft end. In other, not shown embodiments the shaft spindle 3 may be integrated in the impeller, whereas the expression "shaft spindle" also should be understood to include a correspondingly designed and journalled part of an impeller.

The hub assembly 6 comprises a bearing housing 8, an inner sleeve 9 and intermediately disposed roller bearings 10 and 11. The hub assembly 6 is sealed against penetrating water, at the shaft spindle 3 by means of a tightening lid 12 and a seal 13 disposed under the lid, and at the stern end by means of a cap 14. The hub assembly is joined together by means of a tightening nut 15 in threaded engagement with the sleeve 9, outwardly of a bearing plate 16, whereby the sleeve 9 is axially fixed in the bearing housing 8 and concurrently clamping the bearings 10 and 11 between said bearing plate and a radially extended flange 17 disposed on the forward end of the sleeve. Accordingly, the bearing housing, the bearings and the sleeve form a separate, integrated unit. The hub assembly is clamped on the shaft spindle 3 by means of a locking nut 18 screwed thereon.

The bearing housing 8 has a substantially straight or towards the stem tapered, preferably cylindrical outer shape, and radially extended fastening means such as a number of attachment brackets or a flange 19 with through holes for bolting the hub assembly 6 to the stem end of stator 7. The tightening lid 12 has a radial width that corresponds to, or preferably extends inwardly of the periphery of the bearing housing 8, to allow for the free insertion of the bearing housing into the stator 7 from the stem end upon assembling, and upon dismounting to permit a free removal, respectively.

If desirable, a shaft spindle 3 having a tapered section 3' could be journalled in the hub assembly 6, the tapered section having a taper corresponding to the taper of a tapered inner section 9' of the continous cavity through the inner sleeve 9. The sleeve could thereby easily be slided onto the shaft spindle from the stern end, and slided off respectively, enabling the complete hub assembly to be dismounted and reassembled with pump, pump housing, impeller and shaft/shaft coupling still remaining in the propulsion unit.

When tightening the locking nut 18, the desired frictional engagement between the tapered contacting surfaces of shaft spindle and sleeve, respectively, is achieved so that the sleeve rotates with the drive shaft/shaft spindle rotation. Upon dismounting, said frictional engagement is released either mechanically by the use of a puller tool or by an oil injection procedure, wherein pressurized oil is supplied for distribution between the tapered contacting surfaces, e.g. through a channel (not shown) opening at the outer end of the shaft spindle. The locking nut 18 also prevents possible separation of the contacting surfaces caused by the axial thrust which is applied to the shaft spindle by the impeller.

In the disclosed embodiment, a roller bearing assembly having a spherical axial/radial bearing for carrying axial loads is shown. It is however obvious for anyone skilled in the art that the advantages of the invention are not dependent on the bearing assembly shown, but may as well be achieved with the use of other combinations of roller bearings or plain bearings, oil or water lubricated, even if not explicitly shown herein. Furthermore, attachments different from the shown tapered coupling may be utililized to obtain a torsionally stiff connection between sleeve and shaft end/shaft spindle.

I claim:

1. A dismountable hub assembly (6) for the journaling of an impeller (4) drive shaft end (3) in a pump housing (2) of a water jet propulsion unit for the propulsion of a vessel, comprising a bearing housing (8), structured and arranged for connection to a jet pump stator (7) of the pump housing (2);

a sleeve (9), structured and arranged to be axially and non-rotationally fixed to the shaft end (3);

bearings (10,11), rotationally journaling the sleeve relative to the bearing housing;

tightening member (15) axially holding the sleeve relative to the bearing housing, and clamping the bearings in coaxial alignment with the sleeve and the bearing housing, respectively, the bearing housing (8) being structured and arranged to be operationally mounted to a stern end of the jet pump stator (7) by bearing housing mountings, such that the bearing housing mountings are accessible, the hub assembly being dismountable astern from the pump housing (2) as a single unit, without the need to dismount the pump housing (2) and the jet pump stator (7).

2. The hub assembly of claim 1, comprising a continous cavity through the sleeve (9) is adapted to the shape of the shaft end (3) and axially and non-rotationally attached thereto.

3. The hub assembly of claim 2, wherein the cavity has a tapered section (9') with a taper corresponding to a taper (3') of the shaft end, so that when tightening a locking nut (18) on the shaft end, the sleeve is attached to the shaft end under frictional engagement between the tapered surfaces.

4. The hub assembly of claim 1, wherein the bearing housing (8) has a substantially straight or towards the stem tapering, preferably cylindrical outer shape with radially extending attachment means (19) for bolting the bearing housing to a stern side of the jet pump stator (7).

* * * * *